United States Patent [19]

Yoshida

[11] 4,238,300

[45] Dec. 9, 1980

[54] GOLD ELECTROPLATING PROCESS

[75] Inventor: Kei Yoshida, Reading, Pa.

[73] Assignee: Bell Telephone Laboratories, Incorporated, Murray Hill, N.J.

[21] Appl. No.: 42,456

[22] Filed: May 25, 1979

[51] Int. Cl.[3] ..... C25D 3/48

[52] U.S. Cl. ..... 204/46 G

[58] Field of Search ..... 204/46 G, 43 G, 109, 204/DIG. 13; 423/316

[56] References Cited

U.S. PATENT DOCUMENTS

| | | | |
|---|---|---|---|
| 2,812,299 | 11/1957 | Volk et al. | 204/43 G |
| 3,423,295 | 1/1969 | Greenspan | 204/43 G |
| 4,067,783 | 1/1978 | Okinaka et al. | 204/43 G |

FOREIGN PATENT DOCUMENTS

| | | | |
|---|---|---|---|
| 1331064 | 5/1963 | France | 204/46 G |
| 928088 | 6/1963 | United Kingdom | 204/46 G |

OTHER PUBLICATIONS

E. D. Winters, Plating, pp. 213–218, Mar. 1972.

*Primary Examiner*—G. L. Kaplan

*Attorney, Agent, or Firm*—Peter V. D. Wilde; Michael J. Urbano

[57] ABSTRACT

Electrolytic deposition of gold results in the formation of undesirable reducible gold III species in the electroplating bath which interfere with the current efficiency and make the prediction of gold thickness based on applied current impossible. Addition of a small quantity of hypophosphorous acid to the plating bath when the current efficiency has dropped below a certain minimum, chemically reduces accumulated gold III species and scavenges dissolved oxygen. Thus, the current efficiency is restored to about 100%. The hypophosphorous acid treatment is particularly advantageous in a phosphate buffered bath because no foreign ions are introduced into the solution.

5 Claims, No Drawings

GOLD ELECTROPLATING PROCESS

BACKGROUND OF THE INVENTION

1. Field of the Invention

This invention relates to the electrodeposition of gold, and more particularly to a method for improving the current efficiency of an electroplating bath.

2. Description of the Prior Art

Gold electroplating has been used in a variety of applications ranging from purely decorative to industrial. Recently, the expanding electronics industry has created a great demand for gold electroplating processes. The chemical and physical stability, good conductivity, and corrosion resistance of gold makes it ideally suited for use in electronic devices. Gold has been used in integrated circuits for bonding pads, contacts, and current conductors. It has also been useful in making ohmic and rectifying contacts in semiconductor devices since it forms an eutectic with silicon and germanium. Other electronic applications include plating of copper headers and housings for semiconductor diodes where, for example, copper ions would contaminate the device.

Unfortunately, a major problem with gold plating is that the current efficiency (amount of gold plated per quantity of electricity applied) decreases with time. Therefore, the length of time for plating must be increased to ensure a predetermined minimum thickness. This may lead to overplating and consequent waste of gold. Furthermore, the lower plating efficiency may have an effect on the porosity and quality of the deposit. Therefore, when the current efficiency of the bath falls below a certain minimum, the bath must be replaced. Frequent replacement of the bath is wasteful not only of gold, but also of personnel time.

Accordingly, some research has been done to ascertain the cause of the drop in current efficiency with electrolysis time. Conventional plating baths typically use gold I species as the source of gold. Polarographic studies have demonstrated that gold III species accumulate in these solutions with time and have a deleterious effect on the current efficiency. The prior art has proposed the reduction of gold III by chemical reducing agents. Generally, hydrazine has been used. U.S. Pat. No. 4,067,783 suggests a treatment of 0.25 ml 85% hydrazine per 100 ml of bath solution accompanied by heating for a period of time. The problem with hydrazine is that it is a noxious, carcinogenic chemical. Furthermore, excessive hydrazine should be avoided due to its adverse effect on the chemical and physical properties of the gold plating solution. Active charcoal has also been used to restore current efficiency by absorbing certain impurities, but it is not as effective as hydrazine treatment and also absorbs gold species.

In addition to a build-up of gold III species, E. D. Winters, *Plating,* Vol. 72, 213 (1972) demonstrated that oxygen from the atmosphere dissolves into the bath and also decreases the current efficiency as the reduction of the oxygen competes with the reduction of gold I into elemental gold. The prior art suggests inert gas purging or chemical oxygen scavengers for removing the dissolved oxygen. In particular, nitrogen sweeping of the plating solution before and during plating has been suggested. However, this technique may not always be practical. Chemical reducing agents such as hydrazine have been employed. Addition of a complex which will yield a sulfite ion has also been suggested since sulfite reduces the dissolved oxygen to sulphate. However, sulfite can not be used where the pH of the bath is less than 7.

SUMMARY OF THE INVENTION

I have discovered that treating the electroplating bath with hypophosphorous acid, followed by heating for a brief period of time, effectively reduces gold III species and scavenges oxygen so that the current efficiency returns to about 100%. Basically, the technique involves monitoring the current efficiency until it drops below a predetermined minimum, typically below about 80%. At that point, addition of about 0.06–0.10 M (bath vol.) hypophosphorous acid followed by heating the bath to a temperature of at least about 70 degrees C for about 3 hours or more has been found to restore the current efficiency to its original value. The treatment is particularly compatible with phosphate buffered baths since no foreign ions which could adversely affect bath properties are introduced into solution.

DETAILED DESCRIPTION

Conventional plating baths generally contain gold I as the source of gold. The typical industrially-used pure gold electroplating solution contains an alkali-metal-gold-cyanide complex such as potassium aurocyanide, $KAu(CN)_2$ and conducting salts of organic or inorganic reagents such as citrate or phosphate as buffers. Common additives to the pure gold baths include complexing agents, grain refiners, and hardening agents. In such solutions, dicyanoaurate (gold I) is cathodically reduced to elemental gold as follows:

$$Au(CN)_2^- + e^- = 2CN^- + Au \quad \text{(Base)}$$

$$Au(CN)_2^- + 2H^+ + e^- = 2HCN + Au \quad \text{(Acid)}$$

In the conventional dicyanoaurate bath, tetracyanoaurate ions (gold III) accumulate as anodic electrolysis proceeds. Formation of tetracyanoaurate results in a decrease in current efficiency as reduction of the trivalent gold takes three electrons while the monovalent gold requires only one electron.

Furthermore, with an open container, oxygen from the air dissolves into the plating solution, particularly if the solution is agitated. The oxyten competes with gold I reduction according to the overall reactions:

$$O_2 + 4H^+ + 4e^- = 2H_2O \quad \text{(Acid)}$$

$$O_2 + 2H_2O + 4e^- = 4OH^- \quad \text{(Base)}$$

The most notable effect due to oxygen is at low current density, e.g., less than 5 $mA/cm^2$.

Eventually, the accumulations of tetracyanoaurate and dissolved oxygen effectively compete with the desired reduction of dicyanoaurate to elemental gold. The uniformity of deposition thickness and smoothness of the deposit become hard to control. At this point, the bath should be treated with hypophosphorous acid. One method for determining when to add the hypophosphorous acid is by monitoring the current efficiency until it reaches a predetermined minimum. For maximum control, the current efficiency should not go below about 80%. At about 75% the deposits are nonuniform and rough. Current efficiency which is defined as the amount of gold plated per quantity of electricity applied can be measured by plating a preweighed substrate for a fixed time at a fixed current density. Then, the substrate is weighed. The following Nernst equation determines the current efficiency from the weight gain data on the basis of the reduction of gold I:

$$\% \text{ current efficiency} = (100 \times \frac{\text{wt. gain}}{196.97} \times n) / (\frac{I \times t}{F})$$

where I=current in amps, t=electrolysis time in seconds, F=the Faraday (96,500 coulombs per gram-equivalent), and n=number of electrons involved in the reaction, in this case, n=1.

Another means for determining when to add the hypophosphorous acid is by use of polarographic measuring techniques. The concentration of accumulated gold III species can be estimated by using solutions of known concentrations of dicyanoaurate and tetracyanoaurate as described in U.S. Pat. No. 4,067,783 issued to Y. Okinaka et al on Jan. 10, 1978 at Col. 3, line 47-;l Col. 4, line 17. When the concentration of tetracyanoaurate reaches a certain maximum, treatment is warranted.

After addition of the hypophosphorous acid, the bath temperature should be raised above normal to speed up the gold III reduction reaction. In a neutral solution, reduction of tetracyanoaurate $[Au(CN)_4]^-$ may be slow due to the disproportionation reaction:

$$Au(CN)_4^- \rightarrow Au(CN)_2^- + 2CN^- / (CN)_2$$

Caution should be taken not to excessively heat the bath since the heat could adversely affect the properties of the gold plating bath. Bath temperatures typically range between room temperature and about 80 degrees C.; the most common range being between about 50–75 degrees C. Treatment at a temperature of about 70–85 degrees C. for about three hours or more is sufficient.

Hypophosphorous acid treatment has been found to restore the current efficiency to about 100%. The overall chemical equations are:

$$Au(CN)_4^- + H_3PO_2 + H_2O \rightarrow Au(CN)_2^- + H_3PO_3 + 2HCN \quad \text{(Acid)}$$

$$Au(CN)_4^- + H_2PO_2^- + 30H^- \rightarrow Au(Cn)_2^- + HPO_3^{-2} + 2CN^- + 2H_2O \quad \text{(Base)}$$

$$HPO_3^{-2} + O_2 + H^+ \rightarrow PO_4^{-3} + H_2O \quad \text{(Acid)}$$

$$2HPO_3^{-2} + O_2 + 2OH^- \rightarrow 2PO_4^{-3} + 2H_2O \quad \text{(Base)}$$

The hypophosphorous acid is readily oxidized to a higher oxidation state as:

$$[H_2PO_2]^- \rightarrow [HPO_3]^{-2} \rightarrow [PO_4]^{-3}$$

The $[PO_4]^{-3}$ ion is the primary electrolyte of a phosphate buffered bath. Thus, no foreign ions are added to such a solution which could adversely affect the bath properties.

Although maximum advantage is gained by use of the hypophosphorous acid treatment in conjunction with a phosphate buffered bath, the treatment is compatible with other baths as well. It can be employed in deposition of pure gold or alloy, both hard and soft. Some examples are set forth below. Other bath formulations may be found in the literature. A well-known source is *Gold Plating Technology* by F. H. Reid and W. Goldie, Electrochemical Publications Limited, 1974.

EXAMPLE 1

| Soft Gold, Phosphate Buffered | |
|---|---|
| Potassium gold cyanide, $KAu(CN)_2$ | 20g/l |
| Potassium monohydrogen phosphate | 40g/l |
| Potassium dihydrogen phosphate | 10g/l |
| pH | 6~10 |
| temperature | 40–75 degrees C. |
| continuous agitation current density | 5–20mA/in$^2$ |
| anode | platinized titanium |

EXAMPLE 2

| Soft Gold, Citrate Buffered | |
|---|---|
| Potassium gold cyanide | 8g/l |
| Citric acid | 40g/l |
| Sodium citrate | 40g/l |
| pH | 3–6 |
| temperature | room temp. |

The citrate based or phosphate based baths as exemplified in Examples 1 and 2 would be amenable to hypophosphorous acid treatment. There are a few known sodium gold sulfite baths, but sulfite based baths do not accumulate gold III species so there would be no need for the hypophosphorous acid reducing agent. The hypophosphorous acid treatment works well with baths having neutral pH. The pH of hypophosphorous acid is about 4. Therefore, it would also be useful in an acidic bath, such as Example 2. In an alkaline bath, it could cause a pH shift which would have to be compensated for.

EXAMPLE 3

| Hard Gold, Phosphate Buffered | |
|---|---|
| Potassium gold cyanide | 4–46g/l |
| Phosphoric acid to adjust pH to about | 4.2 |
| Cobalt citrate | 20–200ppm |

EXAMPLE 4

| Hard Gold, Citrate Buffered | |
|---|---|
| Potassium gold cyanide | 4g/l |
| Citric acid | 120g/l |
| Tetraethylene pentamine | 20g/l |
| $Ni_3(C_6H_5O_7)_2$ | 2.5g/l |
| pH | 4 |
| temperature | 40 degrees C. |

Examples 3 and 4 are hard gold baths. Common hardners, such as Co and Ni additives, would precipitate the phosphate complex in a citrate buffered bath when hypophosphorous acid is added. However, if a complexing agent for Co or Ni is present, such as tetraethylene pentamine as in Example 4 or an organophosphonate, there will be no phosphate precipitation and the hypophosphorous acid treatment can be used.

EXAMPLE 5

The hypophosphorous acid treatment has been found to produce excellent results in the standard aqueous alkali metal-gold-cyanide bath which is buffered by alkali metal and alkaline earth metal primary and secondary phosphates. The following bath was used in conventional rack plating using metal pieces and metallized wafers as the cathodes.

| Electroplating Bath | |
|---|---|
| $KAu(CN)_2$ | 32.5g/l |
| $K_2HPO_4 . 3H_2O$ | 280g/l |
| $KH_2PO_4$ | 70g/l |
| $Pb^{+2}$ | 0.5 ± 0.3 ppm |
| pH | 7–8 |
| temperature | 70 ± 2 degrees C. |
| continuous agitation | 15 l/min |

The anode was a platinized-titanium electrode available commercially from Sel-Rex Corporation (Nutley, N.J.). An electrical source supplied current at a current density of 5–80 mA/in$^2$.

The current density was monitored by the weight gain technique. When the current efficiency dropped to a value between 75%–80%, the bath was treated with the hypophosphorous acid. I have found that about 0.08 M, calculated by bath volume, is an appropriate quantity under these conditions. After addition of the hypophosphorous acid, the temperature of the bath was raised to about 80 degrees C for at least three hours. After treatment, the current efficiency increased to 101.5% from 75.5%. A value greater than 100% is possible since some gold III species is reduced to elemental gold. After two months of continuous usage, the current efficiency was still 98.5%. The deposits are bright and smooth with a hardness of 97.5 knoop as plated and 45 knoop as annealed.

It is to be understood that the above-described examples are merely illustrative of the many possible specific embodiments which can be devised to represent application of the principles of this invention. Numerous and varied arrangements can be devised with these principles by those skilled in the art without departing from the spirit and scope of the invention. In particular, the hypophosphorous acid treatment is applicable to numerous types of gold plating baths.

I claim:

1. A method of manufacturing an article by steps comprising electrolytically depositing gold from a gold plating bath onto said article, characterized by adding hypophosphorous acid to said bath, with the pH of said bath being in the range of 6 to 10.

2. The method of claim 1 further characterized in that about 0.06–0.10 M (Vol.) hypophosphorous acid is added and said bath is heated to a temperature of at least 70 degrees C. for at least three hours.

3. The method of claim 1 further characterized in that said bath comprises an aqueous solution of a gold alkali metal cyanide and at least one buffer selected from the group of alkali metal and alkaline earth metal primary and secondary phosphates.

4. The method of claims 1, 2, or 3 further characterized by monitoring the accumulation of gold III species and adding said hypophosphorous acid when said accumulation reaches a predetermined value.

5. The method of claims 1, 2, or 3 further characterized by monitoring the current efficiency of said bath and adding said hypophosphorous acid when said current efficiency reaches a predetermined minimum value.

* * * * *